US010294684B1

(12) United States Patent
Shedd

(10) Patent No.: US 10,294,684 B1
(45) Date of Patent: May 21, 2019

(54) PROTECTIVE SHED FOR OUTDOOR UNIT

(71) Applicant: Robert L. Shedd, Marietta, GA (US)

(72) Inventor: Robert L. Shedd, Marietta, GA (US)

( * ) Notice: Subject to any disclaimer, the term of this patent is extended or adjusted under 35 U.S.C. 154(b) by 0 days.

(21) Appl. No.: 15/957,348

(22) Filed: Apr. 19, 2018

(51) Int. Cl.
*E04B 1/12* (2006.01)
*E04H 1/12* (2006.01)
*E04B 1/19* (2006.01)

(52) U.S. Cl.
CPC ..... *E04H 1/1205* (2013.01); *E04B 1/19* (2013.01)

(58) Field of Classification Search
CPC ..... E04H 1/1205; E04B 1/19
USPC ..... 52/63
See application file for complete search history.

(56) References Cited

U.S. PATENT DOCUMENTS 1,946,567 A * 2/1934 Braunworth ..... A47H 99/00 47/40
3,799,608 A * 3/1974 Smutny ..... E04H 1/1205 135/115
4,730,423 A * 3/1988 Hughes ..... E04D 13/0335 135/87
5,226,264 A * 7/1993 Walters ..... E04H 1/1238 135/137
6,158,175 A * 12/2000 Carter ..... F24F 1/58 52/23
6,430,954 B1 * 8/2002 Smith ..... F24F 1/58 135/913
8,689,494 B2 * 4/2014 Leavitt ..... E04H 15/02 135/141
2006/0277675 A1 * 12/2006 Tinnell ..... E04H 1/1216 4/477
2014/0202092 A1 * 7/2014 Bostic ..... F24S 20/67 52/173.3

FOREIGN PATENT DOCUMENTS

WO WO-2005059277 A1 * 6/2005 ..... E04H 15/10

* cited by examiner

*Primary Examiner* — Beth A Stephan
(74) *Attorney, Agent, or Firm* — Sanchelima & Associates, P.A.; Christian Sanchelima; Jesus Sanchelima

(57) ABSTRACT

The present invention provides a shed for shielding an outdoor unit of an air conditioner or the like from exposure to sunlight, rains, etc. The shed includes a ground engaging base on to which the outdoor unit is supported and which lift the outdoor unit to a certain level above the ground. The shed includes four vertical posts, with two of the vertical posts being taller than the other two vertical posts. A roof is supported on the vertical posts such that the roof is pitched in the shed, since the inclination of the roof aids with drainage of any collected rain water or the like therefrom.

13 Claims, 2 Drawing Sheets

PROTECTIVE SHED FOR OUTDOOR UNIT

BACKGROUND OF THE INVENTION

1. Field of the Invention

The present disclosure generally relates to a protective shed for an air conditioner, and more particularly relates to a protective shed for an outdoor unit of the air conditioner to shield it from sunlight and rains without restricting air flow thereto.

2. Description of the Related Art

Air conditioning systems, typically, include an indoor unit which is installed inside the house and extract heat from the surrounding thereof, and an outdoor unit which is in fluid communication with the indoor unit and expels the extracted heat to the atmosphere. The outdoor unit due to the characteristics of its work can only be installed outdoors where it might constantly be exposed to sunlight, rain, dust fall, etc. The outdoor unit includes a compressor, condenser and various other components therein. A fan is also provided within the outdoor unit and operates simultaneously with the compressor to assist in heat removal therefrom. The heat energy generated by the sun's rays impede the heat transfer rate from the compressor to the atmosphere resulting in less efficient cooling by the air conditioning system.

Furthermore, the said components of the outdoor unit are all electric and may have sensitive electronic parts therein. Prolonged exposure of the outdoor unit to such natural factors may also cause damage to such electric components of the outdoor unit. If not damage, it may cause premature wear of the components, thus reducing the working lifespan of the outdoor unit. Moreover, these components being subjected to rain water may lead to increase in the extent of corrosion of metal parts, and in severe cases, can also cause corrosion of the internal components of the outdoor unit.

Accordingly, there is a need for some means which can effectively shield an outdoor air conditioning unit from direct sunlight and may further provide protection against rains to some extent. The various documents describing the closest subject matter provide for a number of more or less complicated features that fail to provide effective protection. None of these documents suggest the novel features of the present invention.

SUMMARY OF THE INVENTION

It is one of the main objectives of the present invention to provide a shed to shield an outdoor unit from sunlight, rains, etc.

It is another objective of the present invention to provide a shed with pitched roof for easy drainage of collected rainwater or the like.

It is still another objective of the present invention to provide a shed which is inexpensive and easy to construct.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Illustrative embodiments of the present invention are described below. The following explanation provides specific details for a thorough understanding of and enabling description for these embodiments. One skilled in the art will understand that the invention may be practiced without such details. In some instances, well-known structures, processes and functions have not been shown or described in detail to avoid unnecessarily obscuring the description of the embodiments.

It shall be noted that unless the context clearly requires otherwise, throughout the description, the words "comprise," "comprising," "include," "including," and the like are to be construed in an inclusive sense as opposed to an exclusive or exhaustive sense; that is to say, in the sense of "including, but is not limited to." Words using the singular or plural number also include the plural or singular number, respectively while adhering to the concepts of the present invention. Furthermore, references to "one embodiment" and "an embodiment" are not intended to be interpreted as excluding the existence of additional embodiments that also incorporate the recited features.

Figure 1:
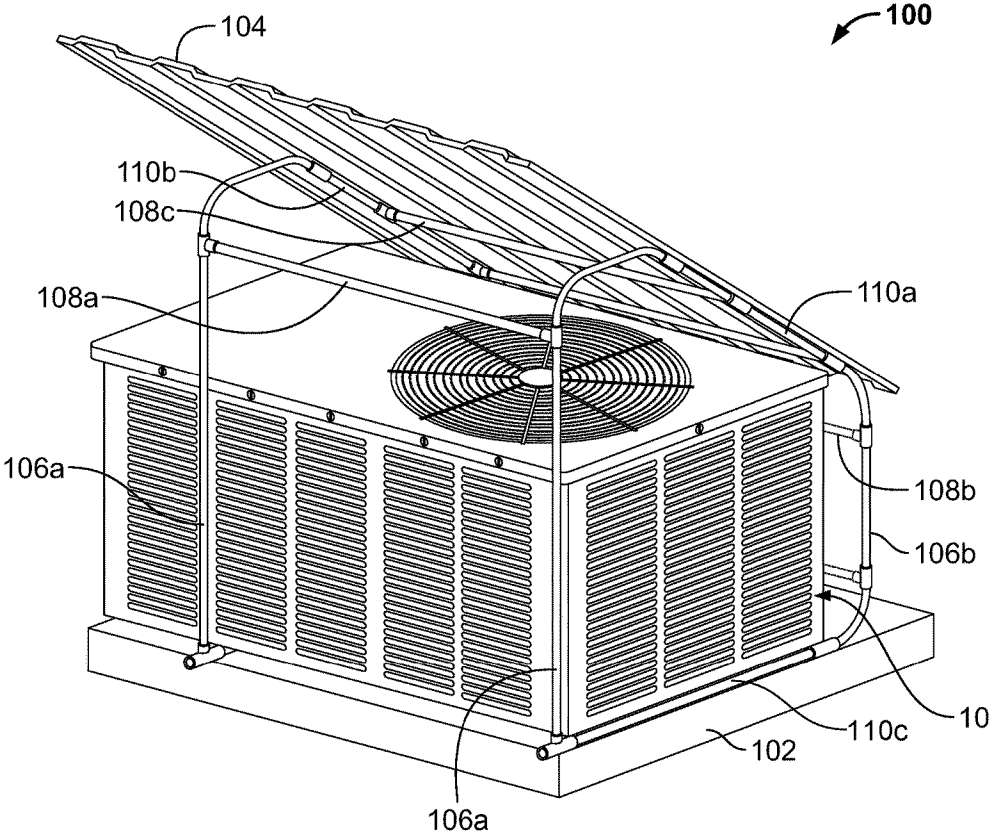
FIG. 1 illustrates a diagrammatic perspective view of a shed, in accordance with one or more embodiments of the present disclosure.

Referring to the drawings, FIG. 1 illustrates a shed (depicted by the numeral 100) for shielding an air conditioner outdoor unit 10, in accordance with one or more embodiments of the present disclosure. The shed 100 protects the air conditioner outdoor unit 10 (hereinafter, interchangeably referred to as "outdoor unit 10") from various harmful occurrences, such as sunlight, rains, etc., and also from dirt/dust, falling objects, etc. to some extent. In the present examples, the outdoor unit 10 is shown to be a condenser unit which expels heats for the air conditioner. In other examples, the outdoor unit 10 may be any electronic or non-electronic device which may need to be shielded from said harmful occurrences or otherwise.

In one or more embodiments, the shed 100 may, optionally, include a ground engaging base 102 to support the outdoor unit 10 at a certain height above the ground. The ground engaging base 102 may generally be in the form of a square or rectangular structure with a certain height. In other examples, the ground engaging base 102 may have any other suitable shape without any limitations. The height of the ground engaging base 102 may be designed to be such that the outdoor unit 10 is disposed at a level above the ground so any stagnant water from rains or small floods may not reach up to the level at which the outdoor unit 10 is located.

In one example, the ground engaging base 102 may be in the form of a fixed platform formed on the ground. For example, the ground engaging base 102 may be a cemented platform. In alternative examples, the ground engaging base 102 may include three or more legs and a flat sheet member or the like supported on top of the legs to provide that minimum height above the ground. The ground engaging base 102 may be a solid or a hollow member with enough strength to support the weight of the outdoor unit 10. For example, the ground engaging base 102 may be made of metal, hard plastic or the like. In some examples, the ground engaging base 102 may provide apertures (not shown) to which the outdoor unit 10 may be fixed by fastening members or the like, in order to ensure that the outdoor unit 10 may not easily move or swayed due to wind storms or the like, and thus prevent possible damage due to falling-off of the outdoor unit 10 from the ground engaging base 102 or the like.

As illustrated, the shed 100 provides a protective frame structure having a roof 104 supported on one or more vertical posts 106. In an embodiment, the vertical posts 106 are supported and fixed on the ground engaging base 102, or directly on the ground, at their lower ends. Hereinafter, any reference to the ground engaging base 102 may be replaced with that to the ground itself without any limitations. For instance, in one example, the vertical posts 106 are cemented with the ground engaging base 102. In other examples, as illustrated, the vertical posts 106 may be secured to the ground engaging base 102 by means of connectors, like nails, etc. The vertical posts 106 are generally orthogonally erected with respect to the ground engaging base 102; however, in other examples, the vertical posts 106 may generally be arranged at an angle with respect to the ground engaging base 102 without affecting the scope of the present disclosure.

In the present examples, as illustrated, the shed 100 includes four vertical posts 106. As in the preferred example, the ground engaging base 102 being in square or rectangular shape, the four vertical posts 106 may be arranged at four corners of the ground engaging base 102. In other examples, the number of vertical posts 106 may be more or less depending on the shape of the ground engaging base 102 underneath and/or the shape of the roof 104 to be supported thereon. In one or more examples, the vertical posts 106 may be cylindrical shaped columns. The vertical posts 106 may be constructed of metallic or non-metallic materials without any limitations.

Figure 2:
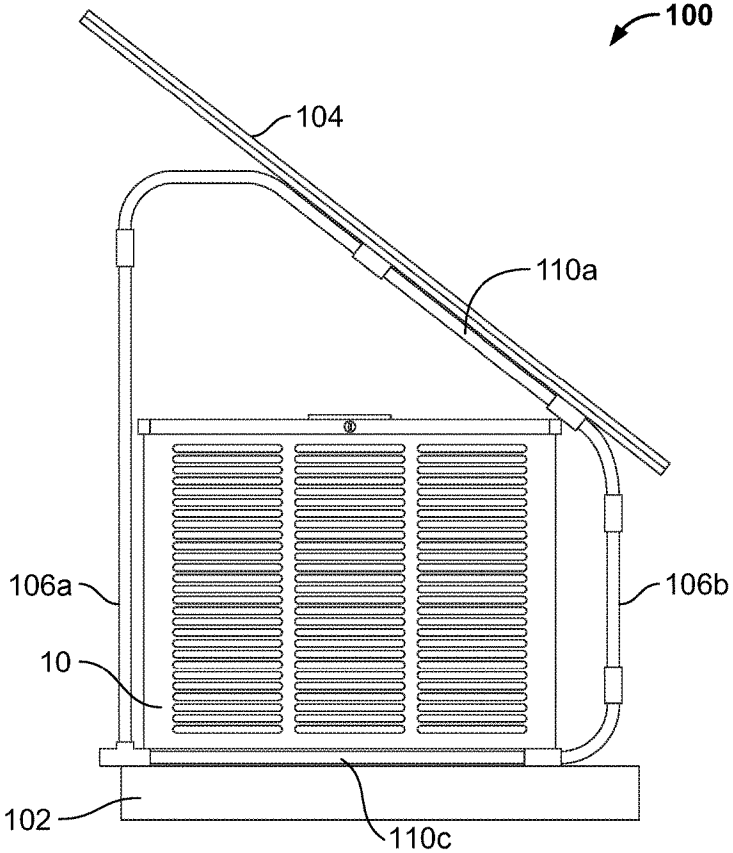
FIG. 2 illustrates a diagrammatic side view of the shed of FIG. 1, in accordance with one or more embodiments of the present disclosure.

As may be seen from FIGS. 1-2, the four vertical posts 106 may be divided into two sets, with a first set of two vertical posts 106*a* being arranged along one of the ground engaging base 102 and a second set of two vertical posts 106*b* being arranged along an opposing edge of the ground engaging base 102. In the illustrated examples, only one vertical post 106*b* from the second set of two vertical posts 106*b* has been shown. In an embodiment of the present disclosure, the two vertical posts 106*a*, in the first set, are generally taller as compared to the two vertical posts 106*b*, in the second set. It may be understood that the vertical posts 106 in the same set 106*a* or 106*b* may generally have same height. In some examples, as illustrated more clearly in FIG. 1, the vertical posts 106 in the same set 106*a* or 106*b* may be coupled with each other by means of bars, like a first bar 108*a* and a second bar 108*b* which provides strength to the said shed structure. In some examples, the two vertical posts 106 in the same set 106*a* or 106*b* may be coupled by means of more than one bar without any limitations.

Further, the shed 100 may include two connecting members, a first connection member 110*a* and a second connection member 110*b*. As illustrated, the first connection member 110*a* may connect one of the vertical post 106*a*, from the first set, to one of the vertical post 106*b*, from the second set, which is disposed along a same edge as the corresponding vertical post 106*a*. Similarly, the second connection member 110*b* may connect other of the vertical post 106*a*, from the first set, to other of the vertical post 106*b*, from the second set, which is disposed along a same edge as the corresponding other vertical post 106*a*. In the present examples, the connecting members 110*a* and 110*b* are connected to the vertical posts 106 at their top ends. In some examples, the verticals posts 106*a* and 106*b* from the two sets may also be connected to each other via two third connection members (only one third connection member 110*c* shown in FIGS. 1-2) at their lower ends, and the third connection members 110*c* support the verticals posts 106*a* and 106*b* on the ground engaging base 102. In some examples, the connecting members 110*a* and 110*b* may also be coupled with each other by means of a bar, such as a third bar 108*c* (as shown in FIG. 1) which adds to strength of the said shed structure. It may be contemplated that the bars 108*a*, 108*b* and 108*c*, and connection members 110*a* and 110*b* may be connected to the corresponding vertical posts 106 by connectors, such as, but not limited to, T-joints or the like.

As noted earlier, and illustrated in FIGS. 1 and 2, the roof 104 is supported on the vertical posts 106. In one or more embodiments, the roof 104 is coupled to the connection members 110*a* and 110*b* by means of any suitable fastening means, for example, connectors, such as common nails, brackets and the like. Due to difference in heights between the vertical posts 106*a* in the first set and the vertical posts 106*b* in the second set, the connecting members 110*a* and 110*b* may generally be disposed at an angle with respect to the ground engaging base 102, in the present shed 100. And, due to the inclined connection members 110*a* and 110*b*, the roof 104 is also inclined or pitched in the shed 100. In alternate examples, the roof 104 may be flat without affecting the scope of the present disclosure. In the present embodiments, the roof 104 is substantially a square or rectangular shaped lean-to structure. In alternate examples, the roof 104 may be circular or some other shape depending on the outdoor unit 10 disposed underneath. In one or more examples, the roof 104 may be composed of wood, plywood, vinyl, metal (like aluminum) or a combination of materials. In one embodiment, the roof 104 may be constructed from corrugated roofing sheets which are well known in the art and widely available in the markets. Preferably, the roof 104 is constructed with materials which reflect light and heat. For example, the roof 104 may be coated in reflective paint capable of reducing the heat absorption of the shed 100.

In one or more examples, the shed 100 may optionally include one or more side walls (not shown), whether completely or partially enclosing the outdoor unit 10 therein. In some examples, the shed 100 may be completely enclosing the outdoor unit 10 therein. The shed 100 may optionally provide the features of a storage housing by implementing in addition, such as a door, one or more windows, alone or in combination. In some examples, solar panels may be installed on the roof 104 to implement the shed 100 for electricity generation using the sunlight to which it is subjected.

The shed 100 of the present disclosure is inexpensive and easy to construct, requiring minimal tools and skills from the user. Further, the shed 100 could be easily disassembled and re-assembled, if required. The reflective roof 104 may significantly reduce the heat exposure to the outdoor unit 10 and further protect the outdoor unit against rain water, without restricting the airflow thereto. The pitched or inclined roof 104 may help to drain away any collected water thereon. The inclination of the roof 104 may be designed to allow for easy drainage of collected water and is set by varying the difference in heights between the vertical posts 106*a* and 106*b* from the two sets. Since the outdoor units of split-system air conditioners are frequently located beneath the eaves of buildings and are thus susceptible to damage from ice and other hard objects falling from the eaves; the present shed 100 when implemented may further protect the outdoor unit 10 from such falling objects.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A protective unit for air conditioning systems, comprising:

a shed having a frame and a roof, an air conditioning unit having opposite perimeter sides, said frame having at least two vertical posts located at the opposite perimeter sides of said air conditioning unit, a first of said at least two vertical posts supporting a first end of said roof and a second of said at least two vertical posts supporting a second end of said roof, said at least two vertical posts are secured to an engaging base, said air conditioning unit mounted over said engaging base.

2. The protective unit of claim 1 wherein said air conditioning unit includes four corners, said at least two vertical posts being four vertical posts each located adjacent to each of said four corners.

3. The protective unit of claim 1 wherein said roof is made of a heat reflecting material.

4. The protective unit of claim 1 wherein said frame includes a longer front end and a shorter rear end, said longer front end includes two longer vertical members spaced apart using at least one transversal front member, said shorter rear end includes two shorter vertical members spaced apart using at least one transversal rear member said two longer vertical members and said two shorter vertical members supporting said roof.

5. The protective unit of claim 4 wherein said shorter rear end includes two transversal rear members.

6. The protective unit of claim 4 wherein said two longer vertical members are connected to said two shorter vertical members using at least one transversal base member extending along the length of at least one side wall of said air conditioning unit.

7. The protective unit of claim 6 wherein said at least one transversal base member includes a first and second transversal base member.

8. The protective unit of claim 7 wherein one of said first or second transversal base members travels underneath said air conditioning unit to connect said two longer vertical members to said two shorter vertical members.

9. The protective unit of claim 1 wherein said roof includes solar panels.

10. The protective unit of claim 1 wherein said frame includes entirely open space between said at least two vertical members adapted to allow circulation of the air expelled from said air conditioning system.

11. The protective unit of claim 1 wherein said roof is sloped at a 30-75 degree angle.

12. The protective unit of claim 1 wherein said at least two vertical members are connected using a diagonal member that is flush and in abutting engagement with said roof and supports said roof.

13. The protective unit of claim 12 wherein a first elbow joint is used to connect one of said at least two vertical members to said diagonal member and a second elbow joint is used to connect a second of said at least two vertical members to said diagonal member.

* * * * *